US012383780B2

(12) United States Patent
Gascoigne

(10) Patent No.: US 12,383,780 B2
(45) Date of Patent: Aug. 12, 2025

(54) ELBOW TENDON TREATMENT DEVICES AND METHODS

(71) Applicant: Donald W. Gascoigne, San Clemente, CA (US)

(72) Inventor: Donald W. Gascoigne, San Clemente, CA (US)

( * ) Notice: Subject to any disclaimer, the term of this patent is extended or adjusted under 35 U.S.C. 154(b) by 0 days.

(21) Appl. No.: 18/634,693

(22) Filed: Apr. 12, 2024

(65) Prior Publication Data

US 2024/0293695 A1 Sep. 5, 2024

Related U.S. Application Data

(63) Continuation-in-part of application No. 17/497,718, filed on Oct. 8, 2021, now Pat. No. 11,964,184.

(51) Int. Cl.

| | |
|---|---|
| ***A63B 21/06*** | (2006.01) |
| ***A63B 21/00*** | (2006.01) |
| ***A63B 21/075*** | (2006.01) |
| ***A63B 23/12*** | (2006.01) |
| ***A63B 71/04*** | (2006.01) |
| *A63B 71/06* | (2006.01) |

(52) U.S. Cl.

CPC ..... *A63B 21/0602* (2013.01); *A63B 21/075* (2013.01); *A63B 21/4035* (2015.10); *A63B 23/1281* (2013.01); *A63B 71/04* (2013.01); *A63B 2071/0694* (2013.01)

(58) Field of Classification Search

CPC ..... A63B 21/0602; A63B 21/4035; A63B 23/03508; A63B 23/14; B65D 1/0292; B65D 1/18; B65D 77/062; B65D 88/365; B65D 2519/00507

See application file for complete search history.

(56) References Cited

U.S. PATENT DOCUMENTS

| | | | | |
|---|---|---|---|---|
| 5,731,021 | A * | 3/1998 | Spector | B65D 1/0292 222/105 |
| 6,099,441 | A * | 8/2000 | Bonnet | A63B 21/0602 482/106 |
| 9,623,274 | B2 * | 4/2017 | Holt, IV | A63B 21/075 |
| 9,643,749 | B2 * | 5/2017 | Wagner | B65D 77/062 |
| 2005/0072796 | A1 * | 4/2005 | Penfold | B65D 5/029 222/105 |
| 2014/0256522 | A1 * | 9/2014 | Holt, IV | A63B 21/4035 482/110 |

(Continued)

*Primary Examiner* — Joshua Lee

(74) *Attorney, Agent, or Firm* — Stetina Garred Brucker & Newboles

(57) ABSTRACT

A method of treating elbow tendonitis in a user's arm comprises providing a container having a handle, filling the container with a prescribed volume of water, holding the container by the handle with the arm hanging at the user's side in a starting position defined by an inward facing of the user's palm, thereafter, rotating the container in a first direction until the arm is at a first rotated position defined by an outward facing of the user's palm, holding the arm at the first rotated position for a first hold time of at least six seconds, thereafter, rotating the container in a second direction opposite the first direction, past the starting position, until the arm is at a second rotated position defined by an outward facing of the user's palm, and holding the arm at the second rotated position for a second hold time of at least six seconds.

18 Claims, 10 Drawing Sheets

(56) References Cited

U.S. PATENT DOCUMENTS

| | | | | |
|---|---|---|---|---|
| 2016/0008652 | A1* | 1/2016 | Holt, IV | A63B 21/072 482/93 |
| 2017/0282001 | A1* | 10/2017 | Imbert | A63B 1/00 |

* cited by examiner

ELBOW TENDON TREATMENT DEVICES AND METHODS

CROSS-REFERENCE TO RELATED APPLICATIONS

This application is a continuation-in-part of U.S. patent application Ser. No. 17/497,718, filed Oct. 8, 2021, the entire contents of which is incorporated by reference herein.

STATEMENT RE: FEDERALLY SPONSORED RESEARCH/DEVELOPMENT

Not Applicable

BACKGROUND

For sufferers of elbow tendonitis such as tennis elbow (lateral epicondylitis) or golfer's elbow (medial epicondylitis), there exist various treatments. However, among the available treatments, laser treatments and cortisone injections are expensive, with cortisone being detrimental to the user's health in the long term. Meanwhile, CBD oil and anti-inflammatory medications such as Aleve or Tylenol only treat the inflammation and do not address the root cause of the condition, which is typically a repetitive use injury (RUI).

BRIEF SUMMARY

The present disclosure contemplates various devices and methods for overcoming the drawbacks accompanying the related art. One aspect of the embodiments of the present disclosure is a method of treating elbow tendonitis in a user's arm. The method may comprise providing a container having a handle, filling the container with a prescribed volume of water, holding the container by the handle with the arm hanging at the user's side in a starting position defined by an inward facing of the user's palm, thereafter, rotating the container in a first direction until the arm is at a first rotated position defined by an outward facing of the user's palm, holding the arm at the first rotated position for a first hold time of at least six seconds (preferably at least ten seconds or around thirty seconds), thereafter, rotating the container in a second direction opposite the first direction, past the starting position, until the arm is at a second rotated position defined by an outward facing of the user's palm, and holding the arm at the second rotated position for a second hold time of at least six seconds (preferably at least ten seconds or around thirty seconds).

The first hold time and the second hold time may each be at least eight seconds. The first hold time and the second hold time may each be at least ten seconds.

The method may comprise returning the arm to the starting position after holding the arm at the second rotated position.

The first rotated position and the second rotated position may be greater than 180 degrees apart. The first rotated position and the second rotated position may be greater than 270 degrees apart.

The method may comprise icing the arm after holding the arm at the second rotated position.

The filling of the container with the prescribed volume of water may comprise filling the container up to a fill line corresponding to the user's body weight.

Another aspect of the embodiments of the present disclosure is a device for treating elbow tendonitis. The device may comprise a container defining an opening for filling the container with water, a handle attached to a top of the container, and a plurality of fill lines on a side wall of the container corresponding to different volumes of water, each of the fill lines being labeled with a body weight or range of body weights associated with the corresponding volume of water.

The container may be made of high-density polyethylene (HDPE).

The container may define a bottom, four sidewalls, and a top and have a square cross-section defined by the four sidewalls. The opening may be defined in the top of the container.

The container may define a bottom, six sidewalls, and a top and have a hexagonal cross-section defined by the six sidewalls. The six sidewalls may include two parallel sidewalls having a first length and four sidewalls having a second length that is less than the first length. The opening may be defined in the top of the container.

Another aspect of the embodiments of the present disclosure is a device for treating elbow tendonitis. The device may comprise a container defining a bottom, six sidewalls, a top, and an opening for filling the container with water. The container may have a hexagonal cross-section defined by the six sidewalls. The six sidewalls may include two parallel sidewalls having a first length and four sidewalls having a second length that is less than the first length. The device may further comprise a handle attached to a top of the container.

The container may be made of high-density polyethylene (HDPE).

The opening may be defined in the top of the container.

A height of the container defined between the bottom and the top may be greater than the first length.

The two parallel sidewalls may be separated by a distance equal to the first length.

Another aspect of the embodiments of the present disclosure is a device for treating elbow tendonitis. The device may comprise a container defining an opening for filling the container with water, a handle attached to a top of the container, a holding mount configured to receive a bottom of the container, and a plurality of fill lines on a side wall of the container corresponding to different volumes of water. Each of the fill lines may be labeled with a body weight or range of body weights associated with the corresponding volume of water.

The container may be cylindrical. The holding mount may define an inner diameter that is greater than an outer diameter of the container. The holding mount may include markings indicating degrees of rotation of the container. The container may be made of high-density polyethylene (HDPE). The opening may be defined in the top of the container. The device may comprise a mat configured to support the holding mount. The mat may include markings indicating foot placement of a user. The mat may be attachable to the holding mount.

Another aspect of the embodiments of the present disclosure is a method of treating elbow tendonitis in a user's arm. The method may comprise providing a container having a handle, filling the container with a prescribed volume of water, and placing the container in a holding mount configured to receive the bottom of the container. The method may further include lifting the container, holding the container by the handle with the arm hanging at the user's side, and rotating the container.

Filling the container with the prescribed volume of water may comprise filling the container up to a fill line corresponding to the user's body weight. The container may be cylindrical. The holding mount may define an inner diameter that is greater than an outer diameter of the container. The holding mount may include markings indicating degrees of rotation of the container. Rotating the container may include rotating the container to align a marking on the container with one of the markings on the holding mount. The container may be made of high-density polyethylene (HDPE). The opening may be defined in the top of the container. The method may comprise providing the holding mount on a mat. The mat may include markings indicating foot placement of the user. The method may comprise attaching the holding mount to the mat.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The present disclosure encompasses various embodiments of methods of treating elbow tendonitis and devices used in the treatment of elbow tendonitis. The detailed description set forth below in connection with the appended drawings is intended as a description of several currently contemplated embodiments and is not intended to represent the only form in which the disclosed invention may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second and the like are used solely to distinguish one from another entity without necessarily requiring or implying any actual such relationship or order between such entities.

Figure 1:
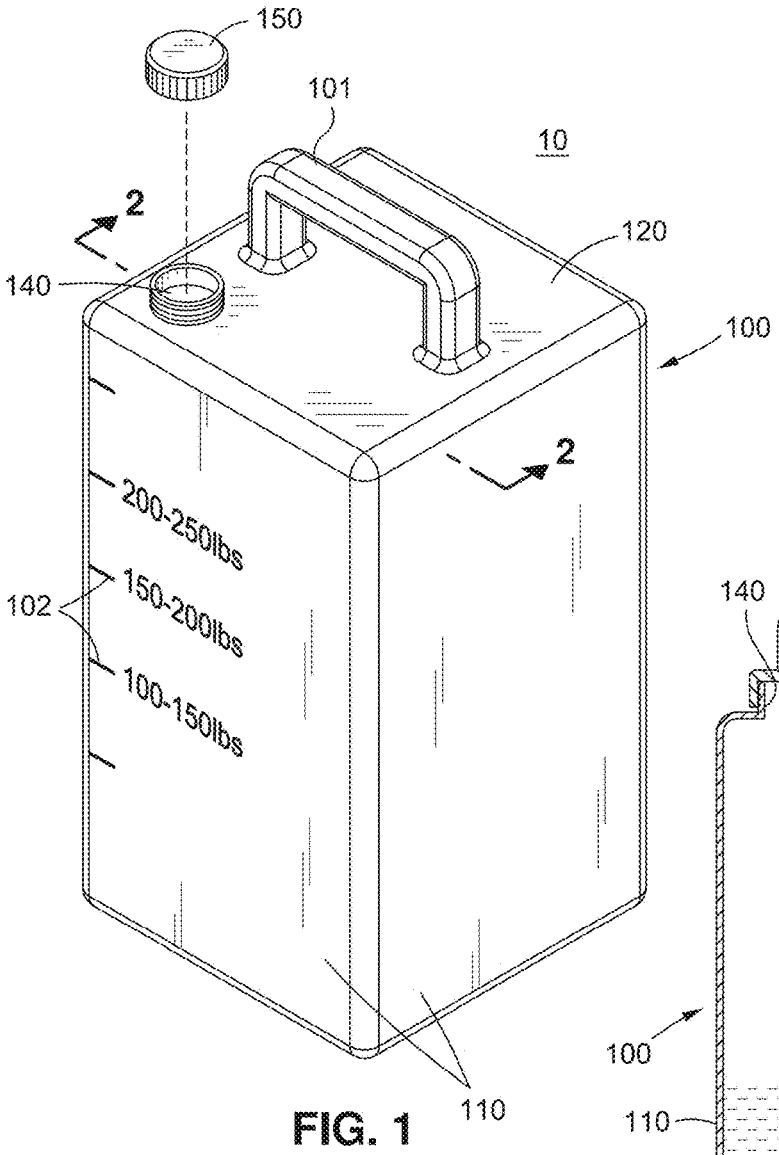
FIG. 1 is a perspective view of a device for treating elbow tendonitis according to an embodiment of the present disclosure.
Figure 2:
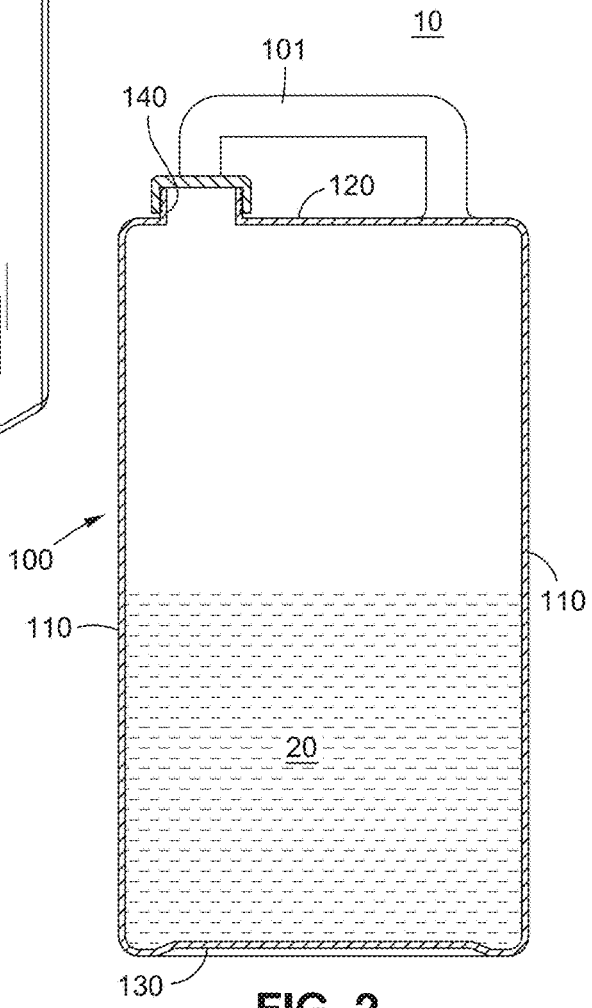
FIG. 2 is a cross-sectional view taken along the line 2-2 in FIG. 1.
Figure 3B:
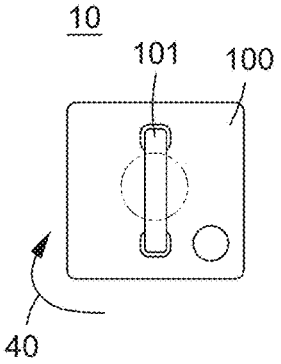
FIG. 3B shows a top view thereof.
Figure 4B:
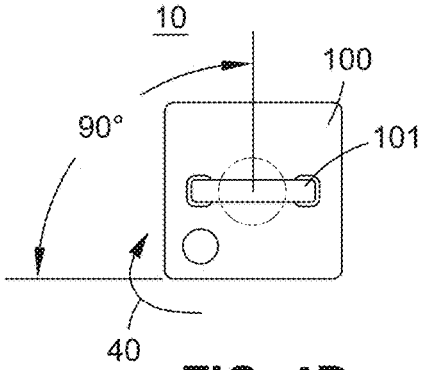
FIG. 4B shows a top view thereof.
Figure 5B:
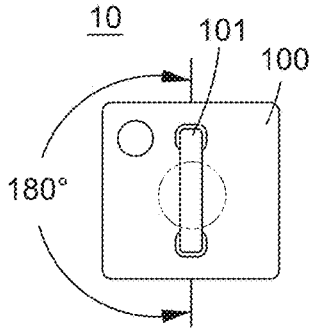
FIG. 5B shows a top view thereof.
Figure 3A:
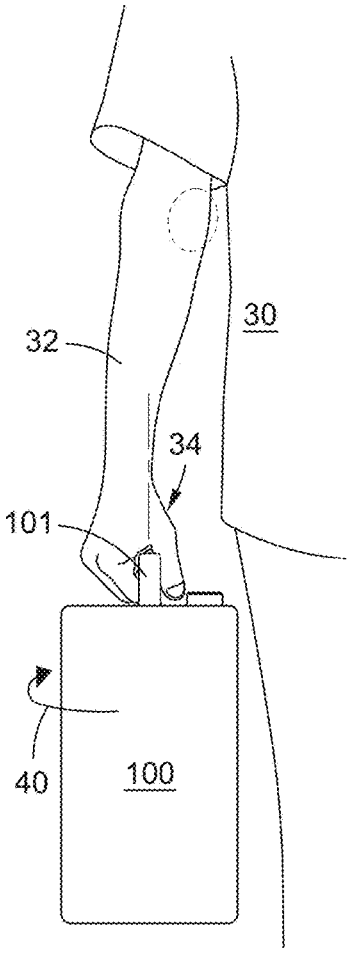
FIG. 3A shows the device being held by a user in a starting position.
Figure 4A:
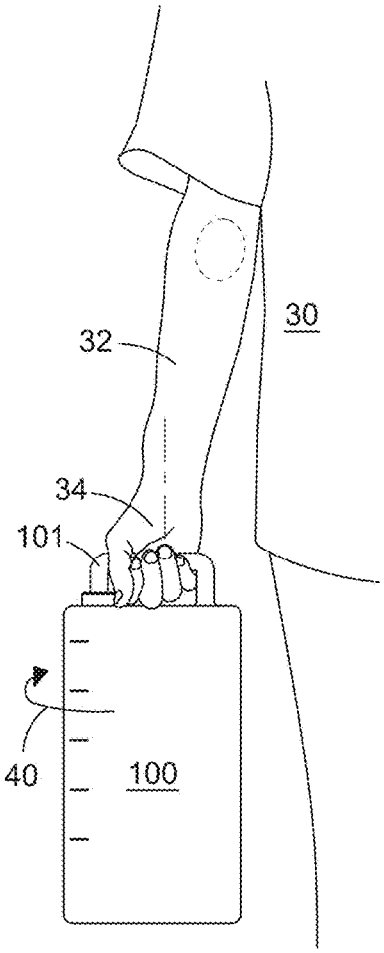
FIG. 4A shows the device being held by the user as the device is rotated toward a first rotated position.
Figure 5A:
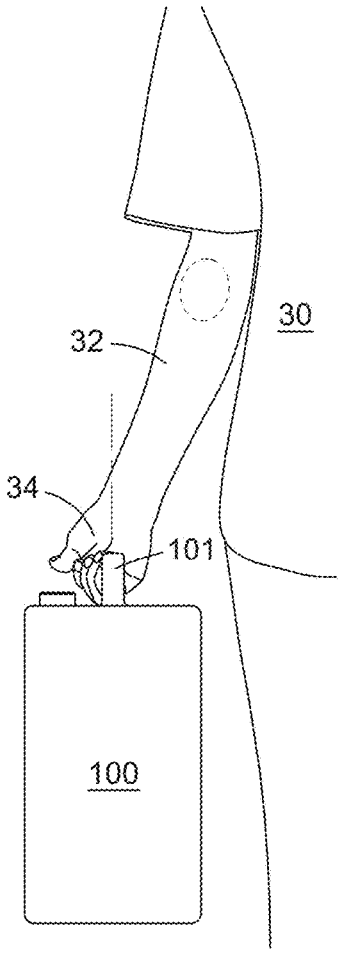
FIG. 5A shows the device being held by the user in the first rotated position.
Figure 6B:
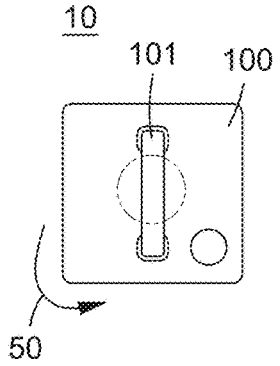
FIG. 6B shows a top view thereof.
Figure 8B:
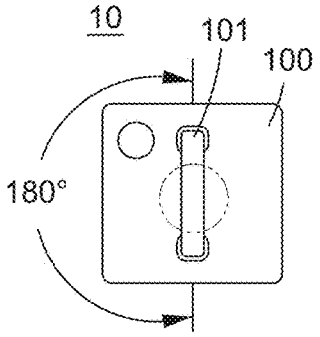
FIG. 8B shows a top view thereof.
Figure 6A:
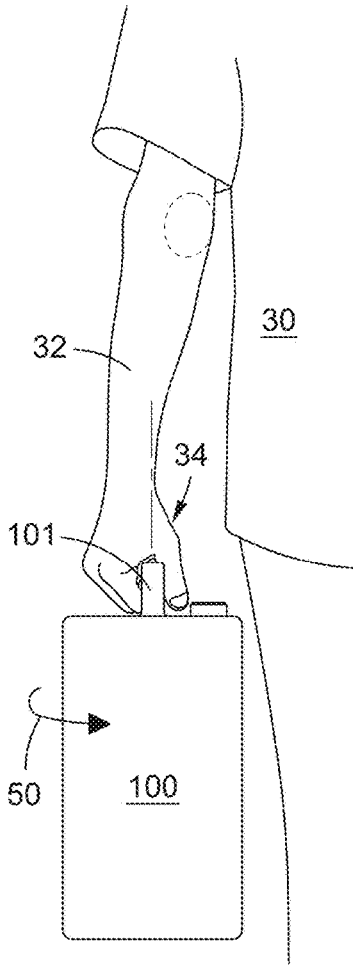
FIG. 6A shows the device being held by the user in the starting position.
Figure 8A:
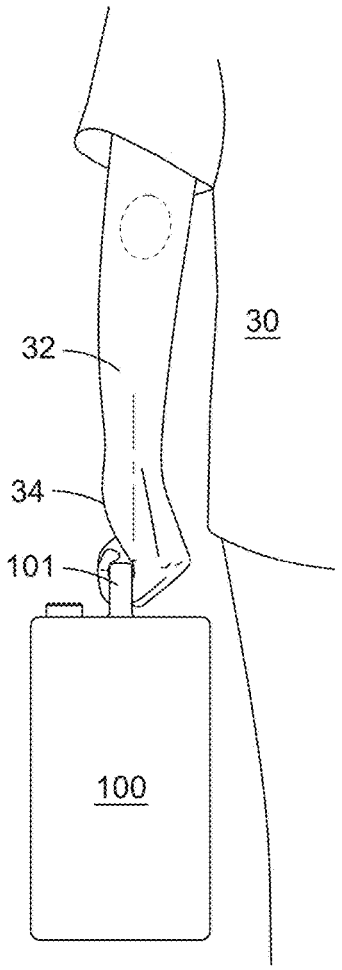
FIG. 8A shows the device being held by the user in the second rotated position.

FIG. 1 is a perspective view of a device 10 for treating elbow tendonitis according to an embodiment of the present disclosure. FIG. 2 is a cross-sectional view taken along the line 2-2 in FIG. 1. The device 10 may comprise a container 100 with a handle 101 positioned to allow a user 30 suffering from tendonitis to easily hold the container 100 at his or her side as shown in FIG. 3A. By filling the container 100 with a prescribed volume of water 20 (see FIG. 2), the user 30 may adjust the weight of the device 10 to produce an effective therapeutic force acting in the direction of gravity to pull downward on the user's arm 32 and extend the user's elbow. In this way, the tendons in the user's arm 32 (shown generally by the dashed oval in FIG. 3A) may be safely elongated to their maximum without injury caused by the weight of the device 10. While in this position, the user 30 may then treat his or her tendonitis by rotating his or her arm 32 clockwise and counterclockwise, holding each extreme position (outward facing palm 34 as shown in FIGS. 5A and 8A) for a prescribed period of time of at least six seconds, for example (preferably at least 10 seconds or around 30 seconds). The rotational motion of the arm 32 in both directions (e.g. 360 degrees or nearly 360 degrees) may work to floss the elongated tendons and reseat them to their normal positions and ranges of motion after they have been displaced by a repetitive use injury (RUI), thereby eliminating inflammation and the pain and weakness associated with the tendonitis condition.

The container 100 may define four sidewalls 110, a top 120, and a bottom 130 (see FIG. 2) and may have a square cross-section defined by the four sidewalls 110. By way of example, the container 100 may be ten to twelve inches on a side and eighteen to twenty-four inches tall, that is, with the sidewalls 110 each being 10×18 or 12×24 inch rectangles, for example, and the top 120 and bottom 130 being 10×10 or 12×12 inch squares (though the corners may be rounded as shown and the bottom 130 may have a raised portion in the center, for example). The container 100 may define an opening 140 for filling the container 100 with water 20. The opening 140 may be two inches in diameter, for example, and may be defined in the top 120 of the container 100 as shown. A cap 150 such as a screw cap or snap-in plug may be provided in order to close the opening 140 once the container 100 is filled with the desired volume of water 20. The container 100, as well as the cap 150, may be made of high-density polyethylene (HDPE) and may be produced by blow molding or rotational molding, for example. The handle 101, which may also be made of HDPE, may be attached to the top 120 of the container 100 in order to allow the container 100 to be easily held from above as the user 30 suspends the container 100 at his or her side during treatment. Without water 20, the device 10 may weigh around seven pounds.

In order to allow the same container 100 to be used for the treatment of a variety of users 30 having different body types, the device 10 may further comprise a plurality of fill lines 102 on a side wall 110 of the container 100 corresponding to different volumes of water 20. Each of the fill lines 102 may be labeled with a body weight or range of body weights associated with the corresponding volume of water 20. As shown in FIG. 1, for example, the fill lines 102 are labeled 100-150 lbs., 150-200 lbs., and 200-250 lbs. When the user 30 fills the container 100 to the fill line 102 matching his or her body weight, the resulting volume of water 20 in the container 100 may be such that the total weight of the device 10 is the correct therapeutic weight for the user's body weight. For example, a larger person with greater body weight may benefit from a greater total weight of the device 10 (and thus more water 20) in order to adequately elongate his or her tendons during treatment. The positions of the fill lines 102 may thus be calibrated to the specific size and shape of the container 100 and labeled accordingly in order to serve as a meaningful guide for filling the container 100 with the appropriate volume of water 20 for a particular user 30.

FIGS. 3A through 8B show an example method of treating elbow tendonitis according to an embodiment of the present disclosure. With the container 100 having been filled with the prescribed volume of water 20 as described above, the user 30 may hold the container 100 by the handle 101 with his or her arm 32 at his or her side (close to the body) in a starting position defined by an inward facing of the user's palm 34 (see FIG. 3A and top view in FIG. 3B). In this position, the user's elbow tendons may be elongated by the weight of the container 100 a safe but therapeutically effective amount corresponding to the user's body weight as described above. The user 30 may thereafter begin rotating the container 100 in a first direction 40 (e.g. clockwise when viewed from above) as shown in FIG. 4A and in the top view of FIG. 4B. The user 30 may continue to rotate the container 100 until the user's arm 32 is at a first rotated position defined by an outward facing of the user's palm 34 (see FIG. 5A and top view in FIG. 5B). In the illustrated example, the container 100 has been rotated a full 180 degrees, but it is contemplated that the user 30 may need to stop before rotating the full 180 degrees. In this regard, the user's palm 34 may be considered to be facing outward at any position between the 90-degree rotation of FIGS. 4A and 4B and the 180-degree rotation of FIGS. 5A and 5B. The first rotated position may thus be defined at any point in this range, with the precise position varying from user to user and/or depending on the severity of the elbow tendonitis condition (which might prevent full rotation of the arm 32).

Figure 7B:
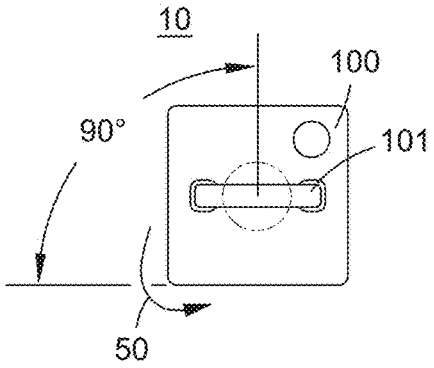
FIG. 7B shows a top view thereof.
Figure 7A:
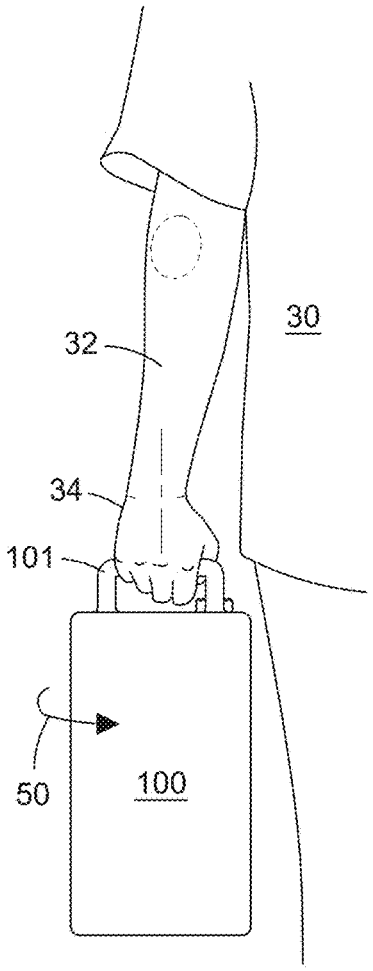
FIG. 7A shows the device being held by the user as the device is rotated toward a second rotated position.

The user 30 may hold his or her arm 32 at the first rotated position for a first hold time of at least six seconds, preferable at least eight seconds, more preferably at least ten seconds or around thirty seconds. Thereafter, the user 30 may rotate the container 100 in a second direction 50 (e.g. counterclockwise when viewed from above) from the first rotated position all the way back to the starting position (see FIG. 6A and top view in FIG. 6B). The user 30 may continue rotating the container 100 past the starting position as shown in FIG. 7A and in the top view of FIG. 7B until the user's arm 32 is at a second rotated position defined by an outward facing of the user's palm (see FIG. 8A and top view in FIG. 8B). Again, the user's palm 34 may be considered to be facing outward prior to the full 180-degree rotation shown in FIGS. 8A and 8B, and thus any position between the 90-degree rotation of FIGS. 7A and 7B and the 180-degree rotation of FIGS. 8A and 8B may be regarded as defining the second rotated position, depending on the user 30 and/or the severity of the condition. As such, the first rotated position (see FIGS. 5A and 5B) and the second rotated position (see FIGS. 8A and 8B), which are the extreme positions of the described method of treatment, may be greater than 180 degrees apart and both defined by outward facings of the user's palm 34. Preferably, the first and second rotated positions may be greater than 270 degrees apart (and may approach or be 360 degrees apart as shown). It is contemplated that a given user 30 may increase the angular distance between the first and second rotated positions over time as the elbow tendonitis condition improves with repeated treatment. At each stage of treatment, the first and second rotated positions may represent the extent of motion that the user's arm 32 can comfortably achieve.

The user 30 may hold his or her arm 32 at the second rotated position for a second hold time of at least six seconds, preferable at least eight seconds, more preferably at least ten seconds or around thirty seconds. After holding his or her arm 32 at the second rotated position, the user 30 may then return the arm 32 to the starting position (see FIG. 3A or FIG. 6A) and release the container 100, thus completing the treatment. For full benefits, the user 30 may afterward ice and rest his or her arm 32 as part of the treatment. The treatment may be repeated as needed, which may be once or twice daily, weekly, etc., depending on the user 30 and the severity of the tendonitis condition.

Figure 9:
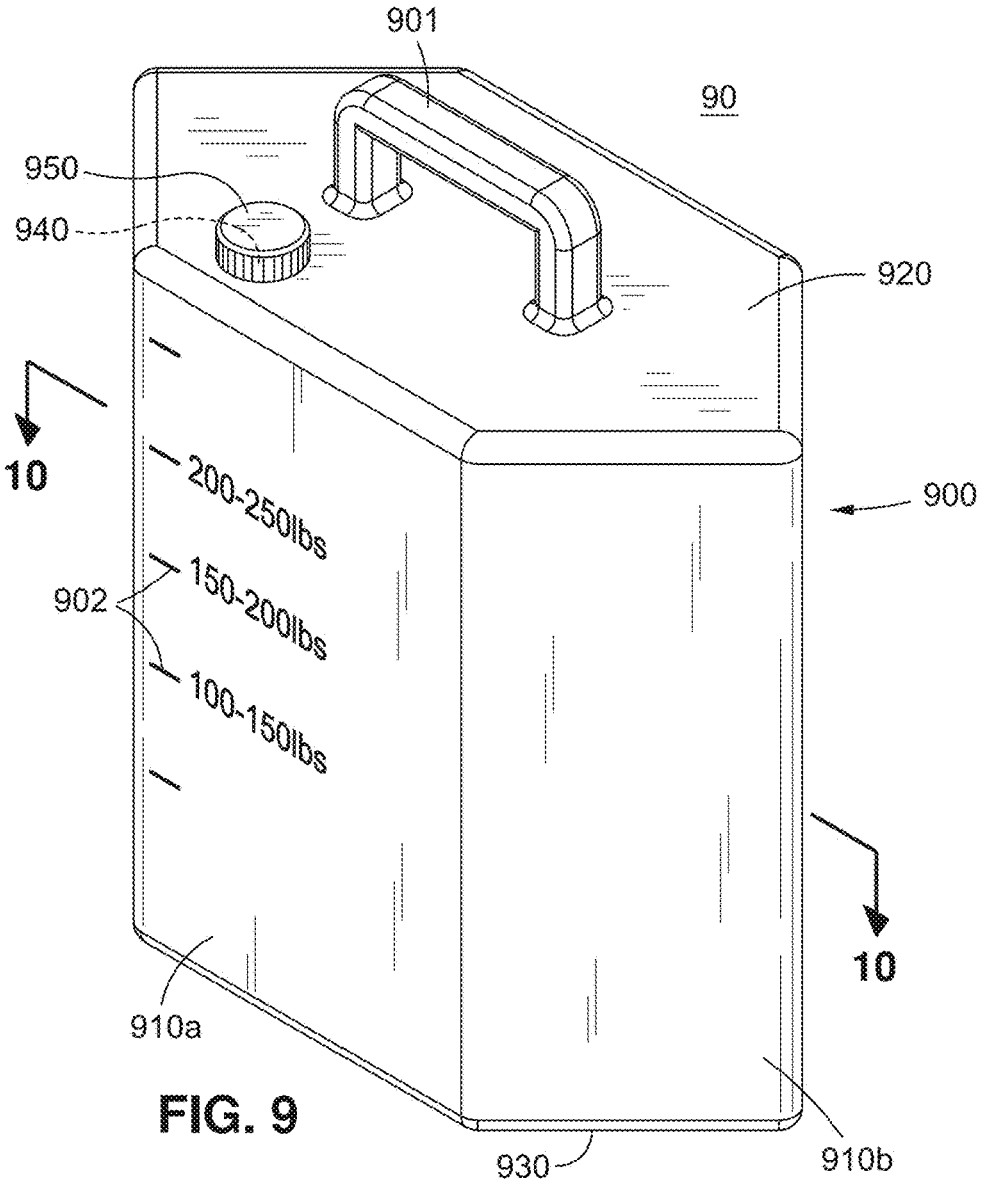
FIG. 9 is a perspective view of a device for treating elbow tendonitis according to another embodiment of the present disclosure.
Figure 10:
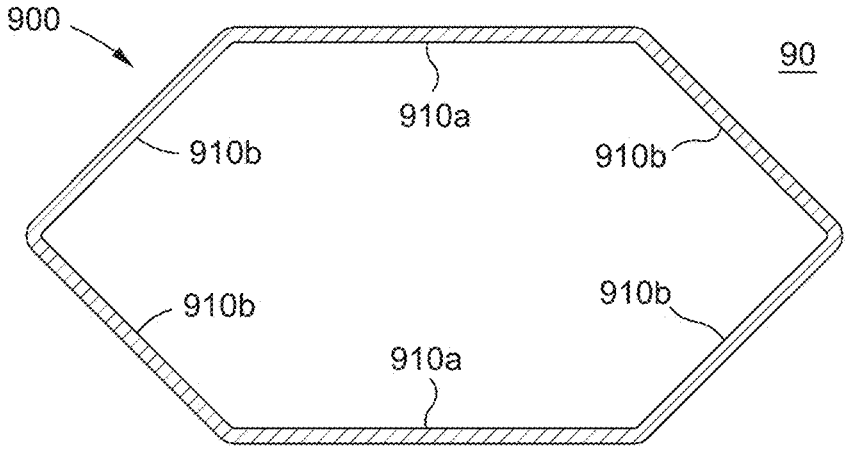
FIG. 10 is a cross-sectional view taken along the line 10-10 in FIG. 9.

FIG. 9 is a perspective view of a device 90 for treating elbow tendonitis according to another embodiment of the present disclosure. FIG. 10 is a cross-sectional view taken along the line 10-10 in FIG. 9. The device 90 may be the same as the device 10 in that it may include a container 900 having sidewalls 910*a*, 910*b*, a top 920, a bottom 930, and an opening 940 with a cap 950 as well as a handle 901 attached to the top 920 of the container 900 and fill lines 902, which may be the same as the container 100, sidewalls 110, top 120, bottom 130, opening 140, cap 150, handle 101, and fill lines 102 discussed above except as follows. Whereas the container 100 has a square cross-section defined by four sidewalls 110, the container 900 has a hexagonal cross-section defined by six sidewalls 910*a*, 910*b*. These may include two parallel sidewalls 910*a* having a first length (which may be less than the height of the container 900) and four sidewalls 910*b* having a second length that is less than the first length. The two sidewalls 910*a* may be separated by a distance equal to the first length. In other words, the two sidewalls 910*a* may be arranged as opposite sides of a square and may be dimensioned and arranged just like the sidewalls 110 of the square container 100. However, instead of the two side walls 910*a* being connected by two more side walls to complete a square cross-section, angled sidewalls 910*b* may be provided, protruding outward to form the hexagonal cross-section. In the illustrated example, each pair of angled sidewalls 910*b* meet at right angles, such that the interior angles include two 90-degree angles and four 135-degree angles. However, other configurations are possible as well, including a regular hexagon having six 120-degree angles.

In use, the device 90 may function in the same way as the device 10, with the following additional feature provided by the angled sidewalls 910*b*. Referring to FIGS. 3A through 8B, as the user 30 rotates his or her arm 32 in either the first direction 40 or the second direction 50, the angled sidewalls 910*b* may be used as intermediate reference points at predefined rotational positions. So, for example, if the user 30 is unable to rotate a full 180 degrees in the first direction 40 or a full 180 degrees in the second direction 50, the user 30 may stop rotating when one of the angled sidewalls 910*b* is resting against his or her leg. In this way, the angled sidewalls 910*b* may be used as reference points so that the user 30 knows how far he or she has rotated the container 900. The user 30 can gradually work toward increasingly greater rotations, corresponding to different sidewalls 910*a*, 910*b*, as treatment continues. In this regard, the two parallel sidewalls 910*a* may have a first length of eight inches, for example, and may correspond to the landings when the palm 34 is facing inward or outward a full 180 degrees, while the four intermediate sidewalls 910*b* may be shorter, e.g. four inches, and may represent gradual steps toward the full 180-degree rotation in either direction. It should be noted that the parallel sidewalls 910*a* may similarly be used as reference points indicating a full 180 degrees of rotation, and that the sidewalls 110 of the square container 100 may also be used as four 90-degree reference points in the same way, though with fewer intermediate steps.

Figure 11:
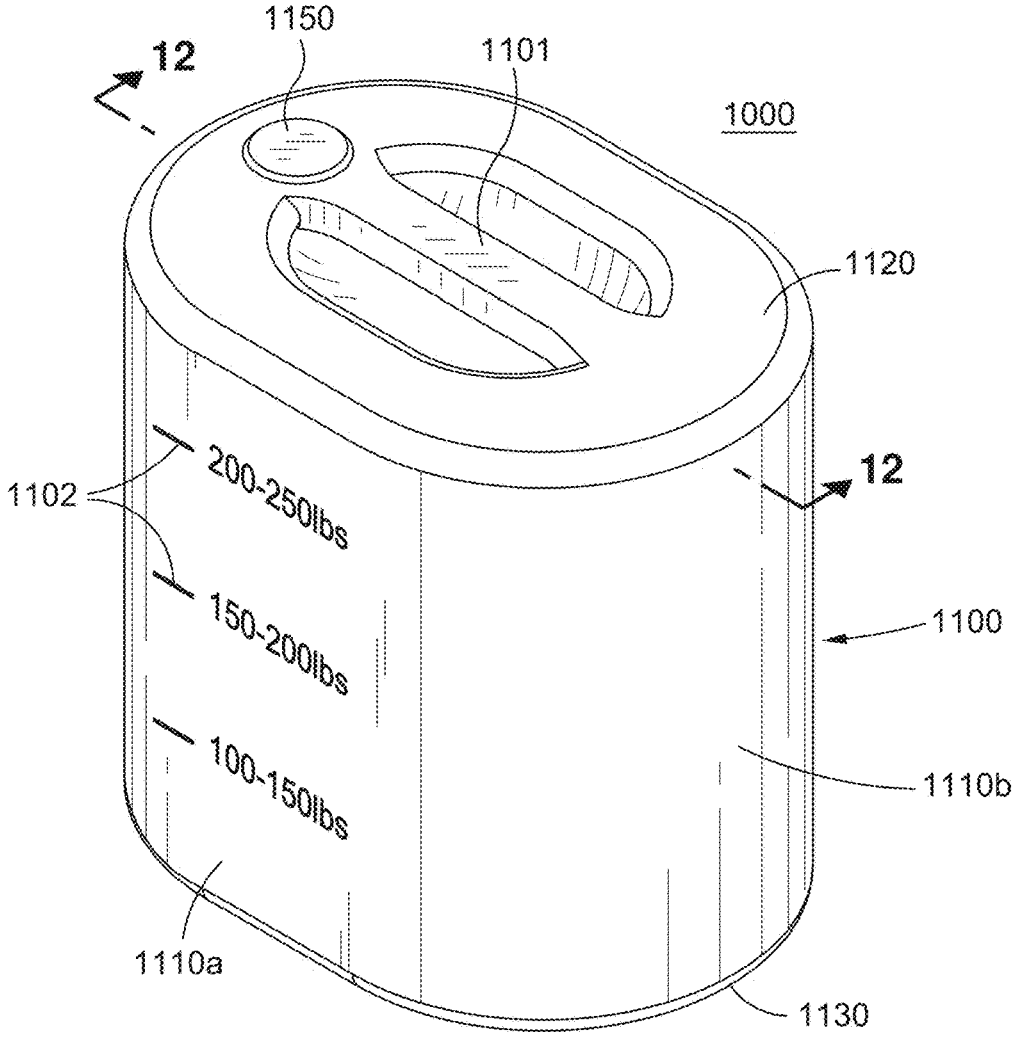
FIG. 11 is a perspective view of a device for treating elbow tendonitis according to another embodiment of the present disclosure.
Figure 12:
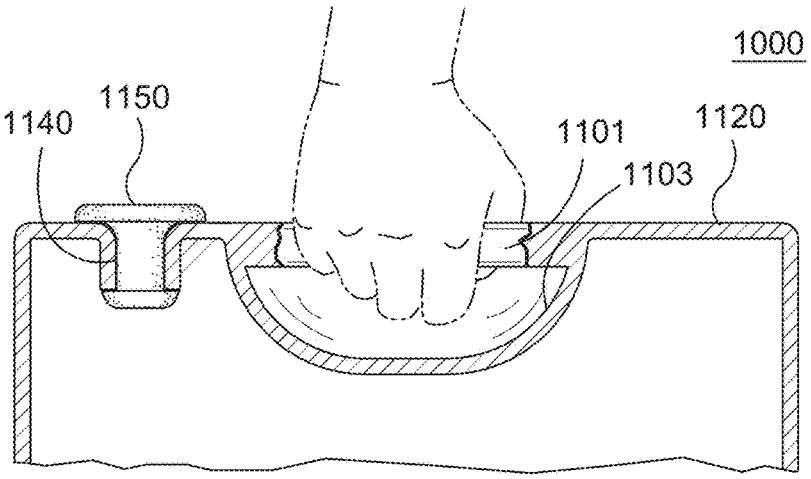
FIG. 12 is a cross-sectional view taken along the line 12-12 in FIG. 11.

FIG. 11 is a perspective view of a device 1000 for treating elbow tendonitis according to another embodiment of the present disclosure. FIG. 12 is a cross-sectional view taken along the line 12-12 in FIG. 11. The device 1000 may be the same as the device 10 in that it may include a container 1100 having sidewalls 1110*a*, 1110*b*, a top 1120, a bottom 1130, and an opening 1140 with a cap 1150 as well as a handle 1101 attached to the top 1120 of the container 1100 and fill lines 1102, which may be the same as the container 100, sidewalls 110, top 120, bottom 130, opening 140, cap 150, handle 101, and fill lines 102 discussed above except as follows. Whereas the container 100 has a square cross-section defined by straight sidewalls 110, the container 1100 has an oval cross-section defined by one or more sidewalls 1110*a*, 1110*b*, at least one of which is curved. The one or more sidewalls may include, for example, two parallel straight sidewalls 1110*a* connected by two semicircular sidewalls 1110*b* as shown. The container 1100 may have an 8×25-inch cross-section (e.g. 8 inches separating straight sidewalls 1110*a*, 25 inches between farthest points of curved walls 1110*b*) and may be 9.8 inches high, for example. More generally, the width may range from five to twelve inches, the length may range from twelve to thirty-six inches, and the height may range from six to twelve inches, for example. Other contemplated configurations having curved sidewalls may include, for example, a single elliptical sidewall that defines the entire cross-section of the container 1100 (i.e. no straight portions). Owing to the curved sidewall(s), a user may more easily rotate the container 1100 by rolling it against his or her thigh when performing a method of treating elbow tendonitis as described herein.

The example of the device 1000 shown in FIGS. 11 and 12 also illustrates a sunken handle 1101 that is flush with the top 1120, though this feature may equally be used with the device 10, device 90, or any other embodiments (or combinations thereof) of the present disclosure. As best seen in FIG. 12, the handle 1101 may be formed as a bridge spanning a recess 1103 formed in the top 1120 of the container 1100. When holding the handle, the user's knuckles may fit within the recess 1103 as shown. By making the handle 1101 flush with the top 1120 in this way, the device 1000 may have a more streamlined exterior shape, making it easier to stack, store, and/or transport the device 1000 without sacrificing ease of use during treatment.

Figure 13:
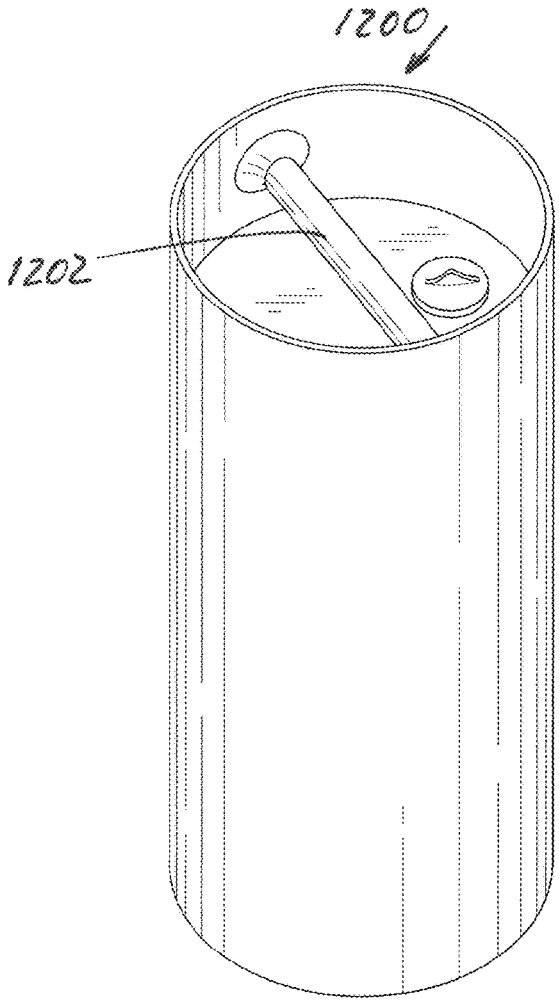
FIG. 13 is a perspective view of a device for treating elbow tendonitis according to another embodiment of the present disclosure.
Figure 14:
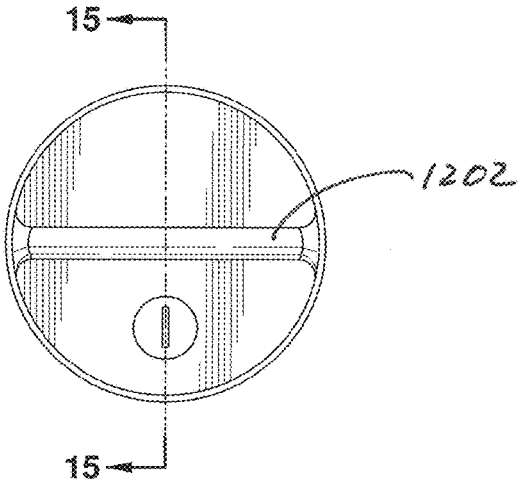
FIG. 14 is a top plan view thereof.
Figure 15:
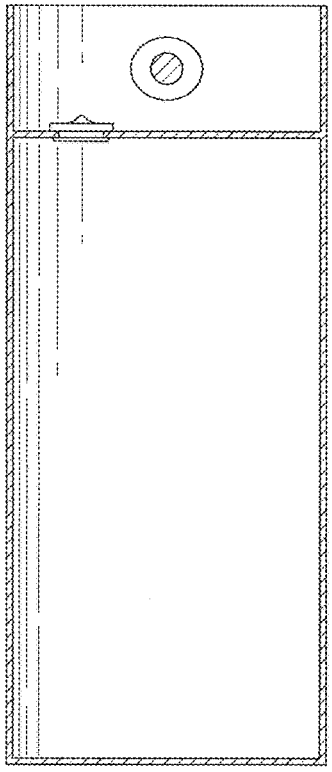
FIG. 15 is a cross-sectional view taken along the line 15-15 in FIG. 14.

FIGS. 13, 14 and 15 show an additional embodiment of the device 1200 for treating elbow tendonitis. FIG. 15 is a cross-sectional view taken about line 15-15 of FIG. 14 and shows that the device 1200 is formed having a cylindrical configuration, the lower portion of which is adapted to receive water or other fluid therein, and the upper portion of which includes a handle 1202, which extends across the central portion of the device 1200. Although not shown, this embodiment of the device 1200 may additionally include a plurality of fill lines on the exterior of the device 120 corresponding to different volumes of water as depicted and described in relation to FIGS. 1, 9 and 11 above. The diameter and height of the device 120 can be formed as desired for any particular applicational use.

Figure 16:
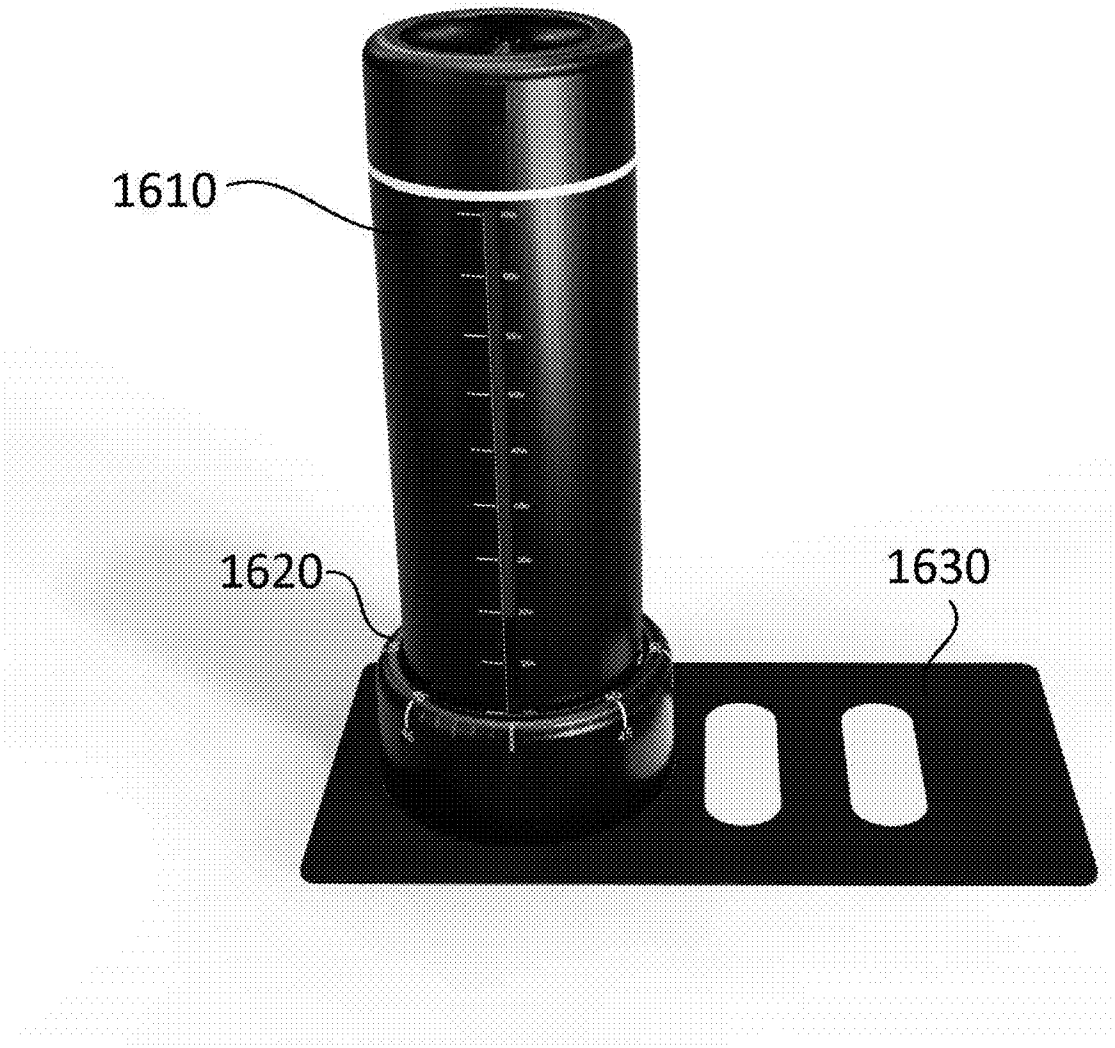
FIG. 16 is a front perspective view of a device for treating elbow tendonitis according to another embodiment of the present disclosure.
Figure 17:
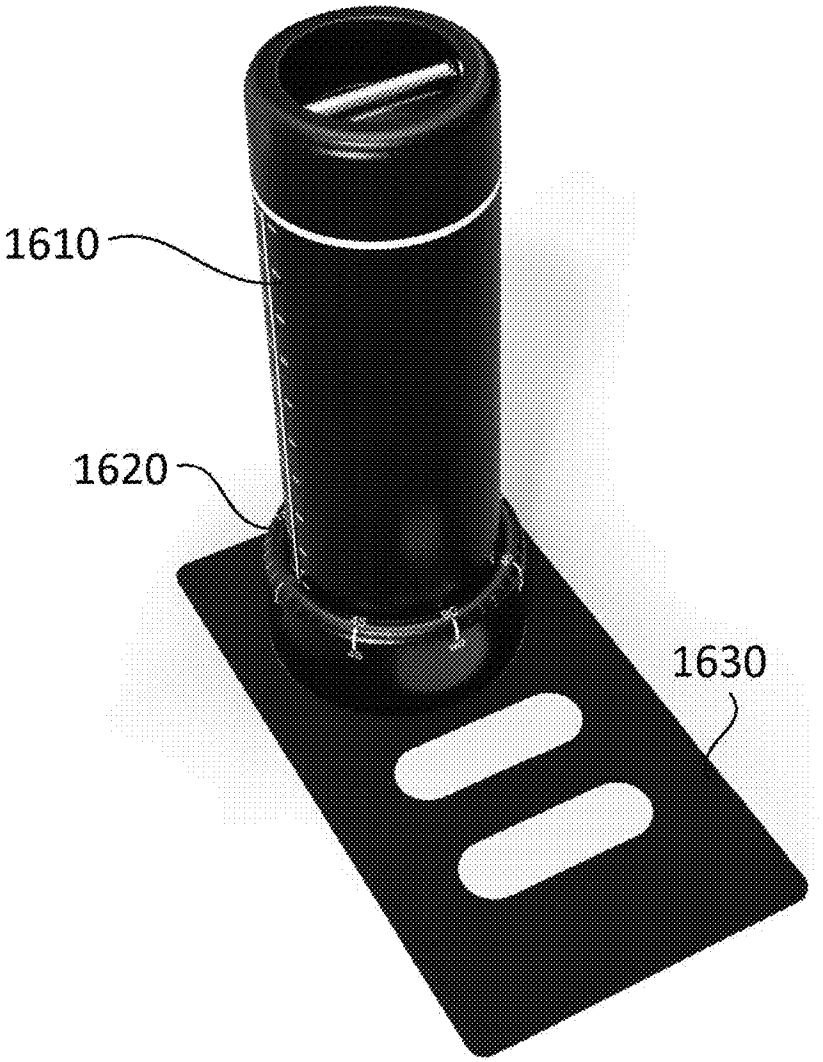
FIG. 17 is a top perspective view thereof.
Figure 18:
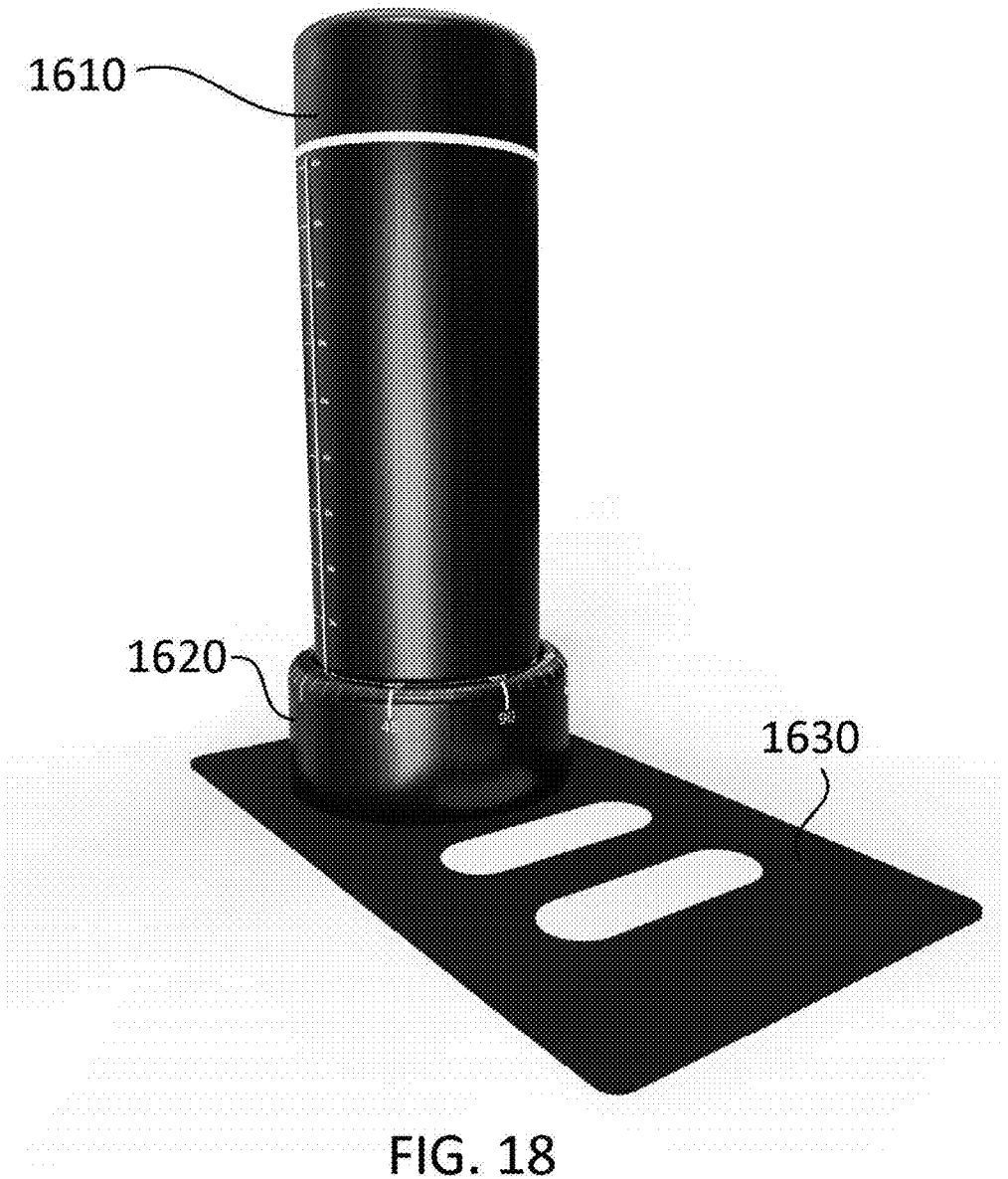
FIG. 18 is a side perspective view thereof.
Figure 19:
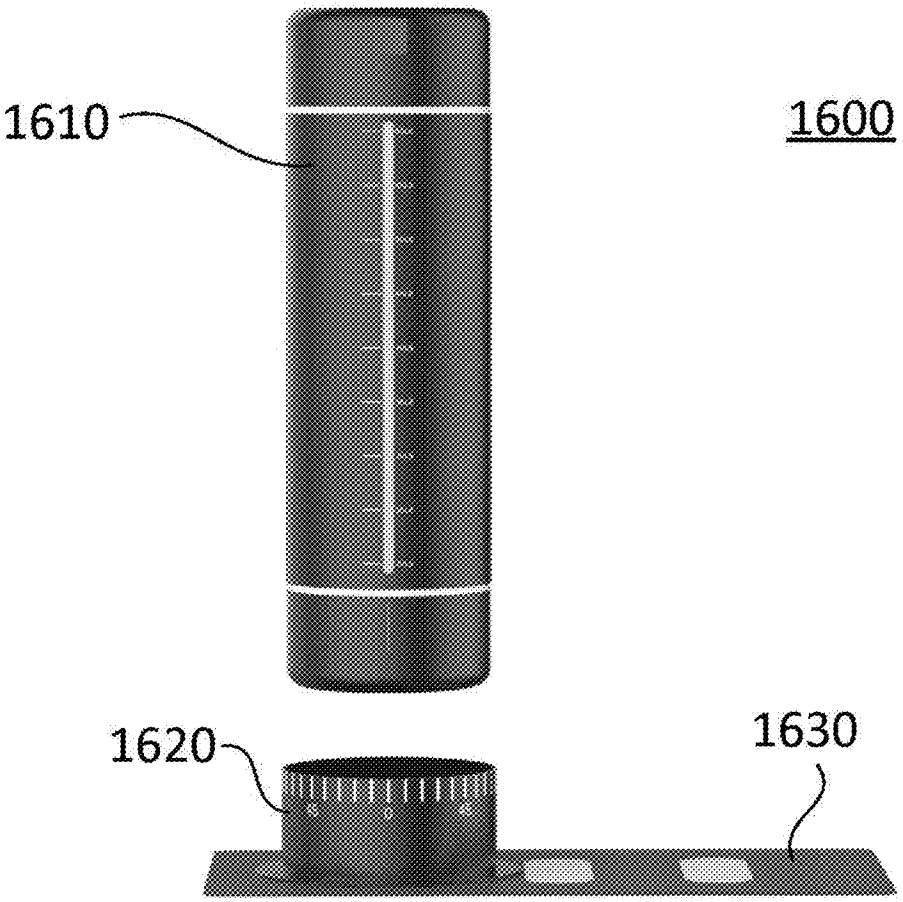
FIG. 19 is a side perspective view thereof in another state of use.

FIGS. 16, 17, 18 and 19 are views of a device 1600 for treating elbow tendonitis according to another embodiment of the present disclosure. The device 1600 may have a cylindrically configured container 1610 that may be the same as the device 1200 describe in relation to FIGS. 13-15, except that the device 1600 may include a holding mount 1620 in addition to the container 1610. The holding mount 1620 may be configured to receive a bottom of the container 1610 and may, for example, be shaped like a ring whose inner diameter is greater than an outer diameter of the container 1610 to allow the container 1610 to be inserted into the holding mount 1620. The device 1600 may additionally include a mat 1630 configured to support the holding mount 1620. The mat 1630 may include markings indicating where the user should place his/her feet during use as shown. The mat 1630 may be attachable to the holding mount 1620 (e.g., by one or more slots formed in the mat 1630). FIGS. 16-18 show a state in which the container 1610 is placed within the holding mount 1620, while FIG. 19 shows a state in which the container 1610 is removed from the holding mount 1620.

The container 1610 may first be filled with water to the desired weight amount relative to the body weight of the user. The weight should provide enough resistance to stretch the tendon during use. In order to fill the container 1610, the user may press down on a pop button under the handle to expose a drain. Once filled, the user may press down on a drain cap under the handle until it clicks and locks securely to prevent any leaks during use. In use, the user may first place the container 1610 into the circular holding mount 1620 to stabilize the container 1610 during use. The user may then grip the handle on the top of the container 1610 and lift the container 1610. The user may place the container 1610 into the holding mount 1620 so that it is safely secured between exercises. Alternatively, it is contemplated that the container 1610 may be tall enough (and the walls of the holding mount 1620 high enough) that the container 1610 may be lifted off the floor (or off the mat 1630) to the height at which it will be used without clearing the height of the holding mount 1620. In this way, the container 1610 may rotate freely within the holding mount 1620 while the lateral position of the container 1610 (in a plane parallel to the ground) may remain fixed. The user may thus rotate the container 1610 within the holding mount 1620 to perform the required movements for rehabilitation. Ensuring that the container 1610 is properly secured in the holding mount 1620 in this way before and/or during use may help to prevent accident or injuries. The user may turn around in order to alternate sides and repeat for both arms. The maintenance routine may typically take less than five minutes to complete. To empty the container 1610, the user may simply open a valve on the bottom of the container 1610 (while the container 1610 is outside the holding mount 1620) to release the water contained inside. This can be done after each use for convenient storage and transportation.

The exemplary device 1600 may advantageously provide an adjustable weight container 1610 for personalized therapy and a circular holding mount 1620 for stability during use. A transparent fill line may allow for precise water measurement (even if the rest of the container 1610 is opaque), while an easy-to-use drain system may allow for convenient filling and emptying. Additional markings may be provided on the holding mount 1620 in order to allow the user to easily see how many degrees of rotation the container 1610 is turned while using the device 1600 (e.g., by lining up the fill line or another line on the container 1610 with angle markings (e.g., 45 degrees, 90 degrees, etc.) on the holding mount 1620.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A device for treating elbow tendonitis, the device comprising:

a container defining an opening for filling the container with water;

a handle attached to a top of the container;

a holding mount configured to receive a bottom of the container; and a plurality of fill lines on a side wall of the container corresponding to different volumes of water, each of the fill lines being labeled with a body weight or range of body weights associated with the corresponding volume of water;

wherein the holding mount includes markings indicating degrees of rotation of the container.

2. The device of claim 1, wherein the container is cylindrical and the holding mount defines an inner diameter that is greater than an outer diameter of the container.

3. The device of claim 1, wherein the container is made of high-density polyethylene (HDPE).

4. The device of claim 1, wherein the opening is defined in the top of the container.

5. The device of claim 1, wherein the device further comprises a mat configured to support the holding mount.

6. The device of claim 5, wherein the mat includes markings indicating foot placement of a user.

7. The device of claim 5, wherein the mat is attachable to the holding mount.

8. A method of treating elbow tendonitis in a user's arm, the method comprising:

providing a container having a handle;

filling the container with a prescribed volume of water;

placing the container in a holding mount configured to receive the bottom of the container;

thereafter, lifting the container;

holding the container by the handle with the arm hanging at the user's side; and rotating the container;

wherein the holding mount includes markings indicating degrees of rotation of the container.

9. The method of claim 8, wherein said filling the container with the prescribed volume of water comprises filling the container up to a fill line corresponding to the user's body weight.

10. The method of claim 8, wherein the container is cylindrical and the holding mount defines an inner diameter that is greater than an outer diameter of the container.

11. The method of claim 8, wherein said rotating the container includes rotating the container to align a marking on the container with one of the markings on the holding mount.

12. The method of claim 8, wherein the container is made of high-density polyethylene (HDPE).

13. The method of claim 8, wherein the opening is defined in the top of the container.

14. The method of claim 8, further comprising providing the holding mount on a mat.

15. The method of claim 14, wherein the mat includes markings indicating foot placement of the user.

16. The method of claim 14, further comprising attaching the holding mount to the mat.

17. A method of treating elbow tendonitis in a user's arm, the method comprising:

providing a container having a handle;

filling the container with a prescribed volume of water;

placing the container in a holding mount configured to receive the bottom of the container;

lifting the container from the holding mount;

holding the container by the handle with the arm hanging at the user's side; and rotating the container;

wherein the holding mount includes markings indicating degrees of rotation of the container.

18. The method of claim 17, wherein said filling the container with the prescribed volume of water comprises filling the container up to a fill line corresponding to the user's body weight.

* * * * *